US005451831A

United States Patent [19]

Lee

[11] Patent Number: 5,451,831

[45] Date of Patent: Sep. 19, 1995

[54] IMPREGNATED PELLET FOR A CATHODE STRUCTURE AND METHOD OF PRODUCING THE SAME

[75] Inventor: Kyung S. Lee, Kyungsangbuk-do, Rep. of Korea

[73] Assignee: Goldstar Co., Ltd., Seoul, Rep. of Korea

[21] Appl. No.: 82,994

[22] Filed: Jun. 25, 1993

[30] Foreign Application Priority Data

Jun. 27, 1992 [KR] Rep. of Korea ..... 11334/1992

[51] Int. Cl.[6] ..... H01J 1/14

[52] U.S. Cl. ..... 313/346 R; 313/346 DC

[58] Field of Search ..... 313/346 R, 346 DC, 354, 313/343–344, 310, 270, 337; 445/35–36

[56] References Cited

U.S. PATENT DOCUMENTS 2,958,798 11/1960 Anton ..... 313/310
3,753,025 8/1973 Van Stratum et al. ..... 313/270
4,031,425 6/1977 Ziegler et al. ..... 313/346 DC
4,310,603 1/1982 Falce ..... 313/346 R
4,916,356 4/1990 Ahern et al. ..... 313/346 R

FOREIGN PATENT DOCUMENTS 58-34540 3/1983 Japan .

*Primary Examiner*—Stephen Brinich
*Attorney, Agent, or Firm*—John P. White

[57] ABSTRACT

An impregnated pellet for a cathode structure according to the present invention is produced by forming a plurality of voids by arranging a plurality of metal rods within a cylinder of heat-resisting metal open at both ends thereof, impregnating the voids with electron emission material, thereby to prepare a rod-shaped pellet base, cutting the rod-shaped pellet base into respective impregnated pellets of a predetermined thickness, and finishing the cut surfaces of the pellets by vibration and tilting operation of working plate. The impregrate pellets can be extensively applied to a cathode-ray tube, an electron tube and the like, which require high current density.

4 Claims, 3 Drawing Sheets

IMPREGNATED PELLET FOR A CATHODE STRUCTURE AND METHOD OF PRODUCING THE SAME

BACKGROUND OF THE INVENTION

1. Field of the Invention

This invention relates to a cathode structure mounted in an electron gun of a picture tube to emit thermions, and more particularly an impregnated pellet for a cathode structure, which is impregnated with electron emission material, and a method of producing the pellet.

2. Description of the Prior Art

Generally, a cathode structure comprises an impregnated pellet 11 composed of heat-resisting metal and thermion emission material and disposed on the top of a cathode sleeve 12 with a cathode heater 13 mounted therein, as shown in FIG. 1 of the accompanying drawings. The impregnated pellets have been used in the past in an oscilloscope and the like requiring a cathode current and at present are also applied to electron tubes such as picture tubes which tend to be large-sized and require high precision and minuteness. Particularly, the impregnated pellet applied to the cathode structure of the picture tube is an important component having a great influence upon the quality and service life of a product.

As shown in FIGS. 2*a* and 2*b*, a prior method of producing the impregnated pellet 11 applied to the cathode structure of the picture tube comprises the steps of preparing a heat-resisting, porous sintered body 11*a* having a plurality of internal and external voids 15,16 by pressing and sintering high temperature and heat-resisting metal powder such as tungsten (W); impregnating the voids 15,16 of the porous sintered body 11*a* with a molten working material such as copper, plastics, etc., and then shaping the impregnated sintered body into an element in the form of a coin having an outer diameter of about 1.5 mm and a thickness of 0.4 mm by machining the sintered body to conform to the area of the top of the cathode sleeve 12(FIG. 1); clearing the voids 15,16 of the copper or plastic material through evaporation of the material by high temperature heating, or dissolution of the material by a chemical treatment; removing the remaining metal fragments on the surface of the pellet produced during the machining work by using fine power and high pressure gas; and impregnating the voids 15,16 of the pellet with molten electron emission material such as barium oxide(BaO), calcium oxide(CaO), alumina($Al_2O_3$), etc., at a high temperature atmosphere. Then, after the impregnated pellet 11 thus produced is subjected to a surface treatment and bonded porous pellet is coated with metal such as osmium(Os), ruthenium(Ru), etc., to lower the work function of the cathode structure.

The impregnated pellet must have a smooth surface so as to facilitate emission of the electrons from the electron emission material 14 in the voids 15,16 of the pellet during the operation. the prior impregnated pellet produced through the steps as set forth above is however disadvantageous in that since fine powder and high pressure gas are used to remove the melts which remain on the surface of the pellet after the impregnation of the voids 15,16 with the molten electron emission material to deteriorate the smoothness of the surface, the manufacturing process is increased, resulting in lower productivity and higher manufacturing cost. In addition, since the internal voids 15 of the porous sintered body 11*a* are isolated from the exterior, only the external voids 16 open to the exterior are impregnated with the electron emission material in the external void is shallow and the distribution of the impregnation areas on the surface of the pellet and the size of each impregnation area are irregular and ununiform. As a result, during the heating operation of the heater of the cathode structure, emission of the thermions from the surface of the pellet may be effected ununiformly and the electron emission material may be exhausted rapidly, thereby to shorten the service life of the product.

SUMMARY OF THE INVENTION

With the foregoing drawbacks of the prior art in view, it is an object of the present invention to provide an impregnated pellet for a cathode structure, which comprises a regular array of heat-resisting metal rods to form voids, which are in turn impregnated with electron emission material, so that uniform emission of thermions can be effected and plastic impregnating and removing steps can be eliminated, thereby to reduce the manufacturing process, resulting in increased productivity and lowered manufacturing cost.

To achieve the above object, there is provided according to one aspect of the present invention an impregnated pellet for a cathode structure comprising a metallic cylinder made of heat-resisting metal and open at both ends thereof, a plurality of metal rods arranged vertically within the metallic cylinder to form a plurality of voids between the metal rods, and electron emission material impregnated the voids.

According to another aspect of the present invention, there is provided a method of producing an impregnated pellet for da cathode structure, comprising the steps of preparing a metallic cylinder open at both ends thereof; forming a plurality of voids by arranging a plurality of metal rods within the metallic cylinder; impregnating the voids with electron emission material thereby to prepare a rod-shaped pellet base; cutting the rod-shaped pellet base into respective impregnated pellets of a predetermined thickness; and finishing the surfaces of the cut pellets by vibration and tiling operation of a working a plate on which a working material of fine powder is distributed.

BRIEF DESCRIPTION OF THE DRAWINGS

In the accompanying drawings.

DETAILED DESCRIPTION OF THE PREFERRED EMBODIMENT

The invention will now be described in detail, by way of example, with reference to the accompanying drawings.

Figure 3A:
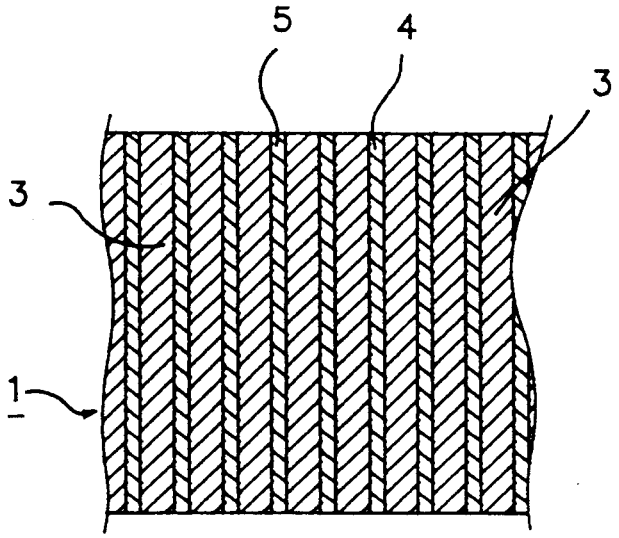
FIGS. 3*a* and 3*b* are vertical cross-sectional and plan views of an impregnated pellet according to the present invention, respectively.
Figure 3B:
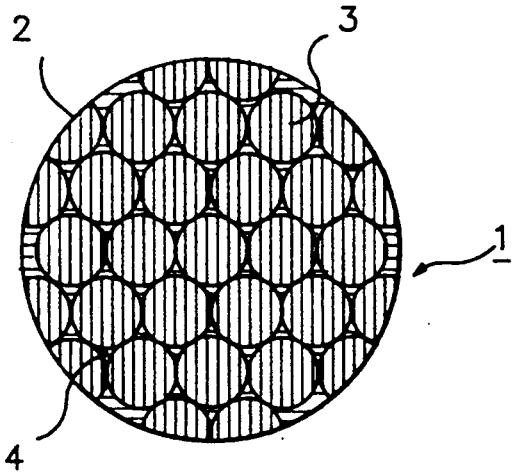

Referring to FIGS. 3*a* and 3*b* showing vertical cross-sectional and plan views of an impregnated pellet for a cathode structure according to the present invention, the impregnated pellet 1 of the present invention comprises a metallic cylinder 2 made of heat-resisting metal and open at both ends thereof, a plurality of heat-resisting metal rods 3 disposed vertically in a given array within the metallic cylinder 2 to form a plurality of voids 5 in the form of a tunnel between the metal rods, and electron emission material 4 molten and impregnated voids 5.

A method of producing the impregnated pellet of the present invention will now be described with reference to FIGS. 4*a*, 4*b* and 5.

Figure 4A:
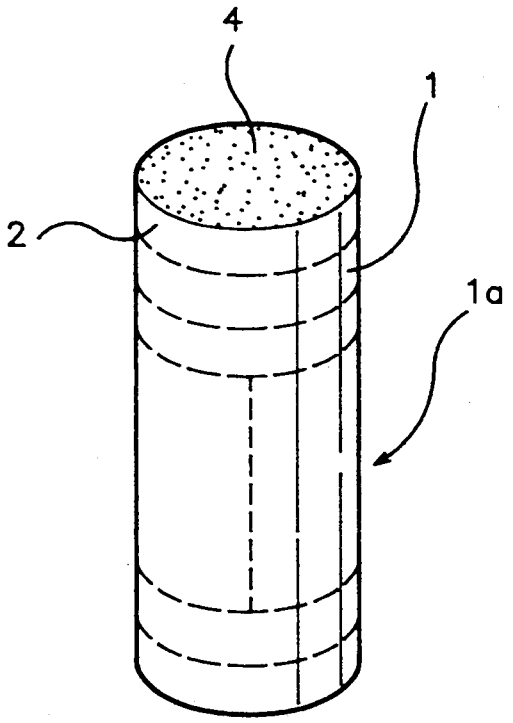
FIG. 4*a* is a perspective view showing a rod-shaped pellet base before being cut into the respective impregnated pellets according to the present invention.
Figure 4B:
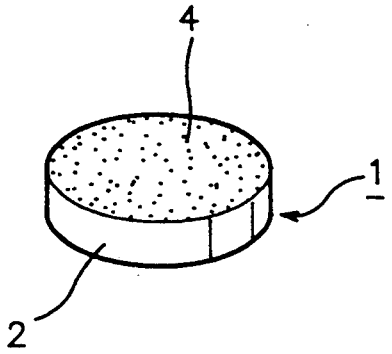
FIG. 4*b* is a perspective view showing one of the impregnated pellets cut from the rod-shaped pellet base.
Figure 5:
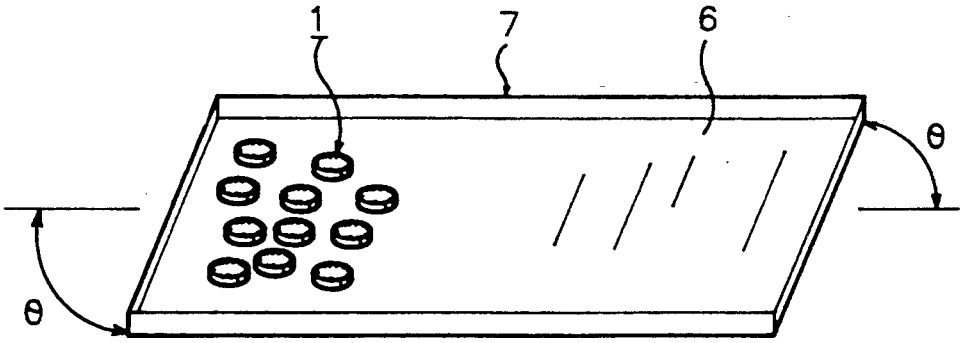
FIG. 5 is a perspective view explaining the operation of a working plate used for a surface treatment of the cut surfaces of the impregnated pellets according to the present invention.

As shown, the method comprises the steps of preparing the metallic cylinder 2 having open opposite ends from high temperature and heat-resisting metal such as molybdenum(Mo) by means of deep drawing, welding, pressing or piping operation; forming the voids 5 by arranging a plurality of the rods 3 of high temperature and heat-resisting metal such as tungsten (W) in a given array within the metallic cylinder 2; impregnating the voids 5 formed by the array of the metal rods 3 with the molten electron emission material 4 of oxides such as barium oxide(BaO), calcium oxide(CaO), alumina($Al_2O_3$), etc., at a high temperature atmosphere, thereby to prepare a rod-shaped pellet base 1*a*, as shown in FIG. 4*a*; cutting the rod-shaped pellet base 1*a* containing the electron emission material 4 into the respective impregnated pellets 1 in the form of a coin having a predetermined thickness (about 0.4 mm), as shown in FIG. 4*b*, by laser or mechanical means; and removing the metal fragments remaining on the cut surfaces of the impregnated pellets 1 through a surface treatment process of the pellets, which comprises placing the pellets i on the surface of a working plate 7 on which a working material 6 comprising fine powder of alumina, tungsten or the like is distributed, and then vibrating and tilting through a predetermined angle($\theta$) the working plate 7, as shown in FIG.5.

Figure 1:
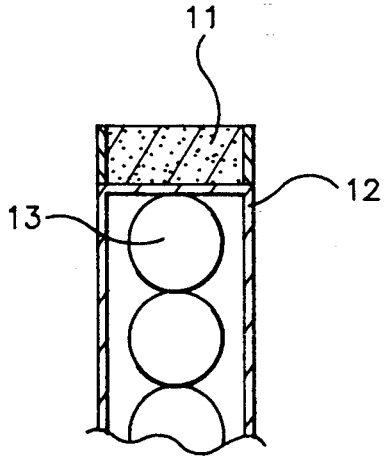
FIG. 1 prior art
FIG. 1 is a vertical cross-sectional view of a conventional cathode structure.
Figure 2A:
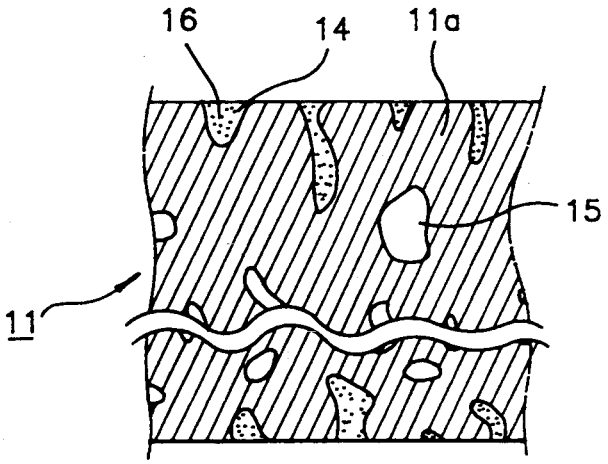
FIG. 2a prior art
FIGS. 2*a* and 2*b* are vertical cross-sectional and plan views of a prior art impregnated pellet, respectively.
Figure 2B:
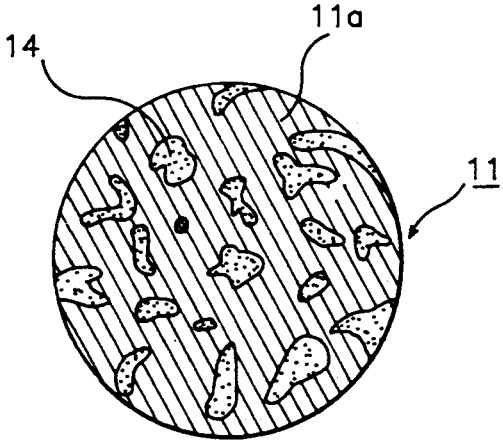
FIG. 2b prior art

Then, the impregnated pellet 1 thus produced is bonded to the top surface of the cathode sleeve 12 with the cathode heater 13 mounted therein, as shown in FIG. 1, and thereafter metal such as osmium(Os), ruthenium(Ru) or the like is coated on the upper surface of the bonded pellet so as to lower the work function of the cathode structure. Thus, assembly of the cathode structure is completed.

Alternatively, the step of impregnating the voids 5 with the electron emission material 4 may be carried out after the step of cutting the pellet base 1*a* into the respective impregnated pellets 1.

Further, in the step of forming the voids 5, although the porosity of the impregnated pellet 1 of more than 9% can be obtained, the size of each void is determined depending upon the shape and size of each metal rod 3. Therefore, it is possible to obtain a desired porosity by varying the configurations of the voids through changes of the arrangement distance and shape of the metal rods. For example, when the pellet is made by arranging the metal rods having a diameter of 0.5 mm, the voids 5 having a diameter of about 0.012 mm are provided in the pellet, so that the porosity of about 10% is achieved. That is, the greater the diameter of the metal rod, the lower the porosity of the pellet. On the contrary, the less the diameter of the metal rod, the higher the porosity of the pellet. Therefore, the diameter of the metal rod 3 can be chosen to obtain an optimum porosity. In addition, the configuration of the void and the porosity of the pellet can be varied with a change of the shape of the metal rod.

As discussed above, since the impregnated pellet 1 of the present invention is made by impregnating a plurality of the voids 5 in the form of a tunnel, which are formed by an array of the metal road 3 and each open at both ends thereof, with the molten electron emission material, uniform emission of electrons form the surface of the impregnated pellet can be induced and exhaustion of the electron emission material due to emission of the electrons therefrom during operation of the cathode heater does not proceed rapidly. Further, since a working material for shaping of a sintered body, as in the prior art, is not necessitated and the impregnated pellets 1 are cut from the rod-shaped pallet base 1*a*, and then subjected at only the cut surfaces to a surface treatment, the manufacturing process is shortened, resulting in lowered manufacturing cost and increased productivity.

While the invention has been shown and described with particular reference to a preferred embodiment thereof, it will be understood that variations and modifications in form and detail may be made therein without departing from the spirit and scope of the invention as defined in the appended claims.

What is claimed is:

1. An impregnated pellet for a cathode structure comprising:

a metallic cylinder made of heat-resisting metal and open at both ends thereof;

a plurality of metal rods arranged vertically within said metallic cylinder to form a plurality of voids between said metal rods; and electron emission material in each of said voids.

2. A method of producing an impregnated pellet for a cathode structure, comprising the steps of:

preparing a metallic cylinder open at both ends thereof;

forming a plurality of voids by arranging a plurality of metal rods within said metallic cylinder;

impregnating said voids with electron emission material thereby to prepare a rod-shaped pellet base;

cutting said rod-shaped pellet base into respective impregnated pellets of a predetermined thickness; and finishing the surface of said cut pellets by vibration and tilting operation of a working plate on which a working material of fine powder is distributed.

3. A method of producing an impregnated pellet for a cathode structure as claimed in claim 2, wherein said step of impregnating said voids with electron emission material is carried out after said step of cutting said rod-shaped pellet base.

4. A method of producing an impregnated pellet for a cathode structure as claimed in claim 2, wherein said working material of fine powder is one or more powder material selected from alumina ($Al_2O_3$) and tungsten(W).

* * * * *